US010539122B2

(12) United States Patent
Yamazaki et al.

(10) Patent No.: US 10,539,122 B2
(45) Date of Patent: Jan. 21, 2020

(54) PLASMA ACCELERATING APPARATUS AND PLASMA ACCELERATING METHOD

(71) Applicants: MITSUBISHI HEAVY INDUSTRIES, LTD., Tokyo (JP); National University Corporation Nagoya University, Aichi-ken (JP)

(72) Inventors: Takuya Yamazaki, Tokyo (JP); Hirofumi Shimizu, Tokyo (JP); Akihiro Sasoh, Aichi (JP); Shigeru Yokota, Aichi (JP); Shota Harada, Aichi (JP); Teruaki Baba, Aichi (JP)

(73) Assignees: MITSUBISHI HEAVY INDUSTRIES, LTD., Tokyo (JP); NATIONAL UNIVERSITY CORPORATION NAGOYA UNIVERSITY, Aichi (JP)

( * ) Notice: Subject to any disclaimer, the term of this patent is extended or adjusted under 35 U.S.C. 154(b) by 0 days.

(21) Appl. No.: 15/313,715

(22) PCT Filed: Jul. 10, 2014

(86) PCT No.: PCT/JP2014/068434
§ 371 (c)(1),
(2) Date: Nov. 23, 2016

(87) PCT Pub. No.: WO2015/177938
PCT Pub. Date: Nov. 26, 2015

(65) Prior Publication Data

US 2017/0152840 A1 Jun. 1, 2017

(30) Foreign Application Priority Data

May 23, 2014 (JP) ..... 2014-107585

(51) Int. Cl.
*F03H 1/00* (2006.01)
*H05H 1/54* (2006.01)
*H05H 1/46* (2006.01)

(52) U.S. Cl.
CPC ..... *F03H 1/0081* (2013.01); *H05H 1/46* (2013.01); *H05H 1/54* (2013.01); *H05H 2001/4667* (2013.01)

(58) Field of Classification Search
CPC .... F03H 1/0062; F03H 1/0075; F03H 1/0068; F03H 1/0025; F03H 1/0081; H01J 27/143; H01J 27/146; H01J 1/025; B64G 1/405
See application file for complete search history.

(56) References Cited

U.S. PATENT DOCUMENTS 2,810,090 A * 10/1957 Macnair ..... H01J 1/025 313/293
4,862,032 A * 8/1989 Kaufman ..... H01J 27/146 250/427

(Continued)

FOREIGN PATENT DOCUMENTS

JP 5-45797 7/1993
JP 2002-516644 6/2002

(Continued)

OTHER PUBLICATIONS

Brophy "Stationary Plasma Thruster Evaluation in Russia" 1992.*

(Continued)

*Primary Examiner* — Gerald L Sung
*Assistant Examiner* — William L Breazeal
(74) *Attorney, Agent, or Firm* — Wenderoth, Lind & Ponack, L.L.P.

(57) ABSTRACT

Plasma which is supplied from a supply passage (1) is accelerated with a Hall electric field (E) which is generated (Continued)

through interaction of electrons ($e^-$) emitted from a cathode (3), a radial direction magnetic field (Bd), and an electric field (Ex).

14 Claims, 9 Drawing Sheets

(56) References Cited

U.S. PATENT DOCUMENTS

| | | | | |
|---|---|---|---|---|
| 5,847,493 | A * | 12/1998 | Yashnov | F03H 1/0075 313/231.31 |
| 7,436,122 | B1 * | 10/2008 | Beal | F03H 1/0075 315/111.21 |
| 2002/0014845 | A1 * | 2/2002 | Raitses | F03H 1/0068 315/111.81 |
| 2002/0163289 | A1 * | 11/2002 | Kaufman | H01J 27/146 313/361.1 |
| 2007/0056515 | A1 * | 3/2007 | Chevalier | H05H 1/46 |
| 2008/0093506 | A1 | 4/2008 | Emsellem et al. | |
| 2012/0217876 | A1 | 8/2012 | Diamant et al. | |
| 2013/0026917 | A1 | 1/2013 | Walker et al. | |

FOREIGN PATENT DOCUMENTS

| | | |
|---|---|---|
| JP | 2007-511867 | 5/2007 |
| JP | 4925132 | 4/2012 |
| JP | 2013-137024 | 7/2013 |
| JP | 2014-5762 | 1/2014 |
| WO | 97/37127 | 10/1997 |

OTHER PUBLICATIONS

International Search Report dated Aug. 5, 2014 in corresponding International Application No. PCT/JP2014/068434.

International Preliminary Report on Patentability dated Dec. 8, 2016 in corresponding International Application No. PCT/JP2014/068434.

Office Action dated Dec. 20, 2017 in corresponding Japanese application No. 2014-107585, with machine translation.

* cited by examiner

PLASMA ACCELERATING APPARATUS AND PLASMA ACCELERATING METHOD

TECHNICAL FIELD

The present invention relates to a plasma accelerating apparatus and a plasma accelerating method.

BACKGROUND ART

As a propulsion apparatus used in a space, an apparatus is known that accelerates and emits plasma to a rear direction to acquire thrust force with reaction of the emission. Patent Literature 1 discloses an electric propulsion machine that acquires the thrust force by ejecting plasma generated through arc discharge from a nozzle. Patent Literature 2 discloses an ion engine that selectively accelerates charged particles that are generated through discharge by using a screen electrode and an acceleration electrode.

Also, a Hall thruster which uses a Hall current is known as a propulsion apparatus. As shown in FIG. 1, in the Hall thruster, electrons supplied from the cathode carry out a Hall movement (forms a Hall current) in a circumferential direction through interaction of an electric field and a magnetic field. The electrons carry out the Hall movement to ionize the propulsion material so as to generate plasma. The plasma is accelerated with the electric field and is emitted into a rear direction.

Moreover, as an apparatus which accelerates the electrodeless plasma generated by an electrodeless plasma generating apparatus, an accelerating apparatus by a magnetic nozzle and an accelerating apparatus (the Lissajous accelerating apparatus) by a rotating electric field or a rotating magnetic field are known. Here, the electrodeless plasma generating apparatus is defined as a plasma generating apparatus which an electrode and the plasma do not contact directly in a plasma generation process. As shown in FIG. 2, the magnetic nozzle accelerates the plasma by using a magnetic coil. The magnetic coil converts thermal energy of the plasma to kinetic energy which heads to the rear direction of the nozzle. As shown in FIG. 3, in a Lissajous acceleration apparatus, the plasma is rotated in a circumferential direction by using a rotating electric field (or a rotating magnetic field). The plasma is accelerated through interaction (Lorentz force) of the plasma rotating to the circumferential direction (the Hall current) and a divergent magnetic field of the magnetic coil.

CITATION LIST

[Patent Literature 1] JP_H05-45797B1 (Japanese Patent No. 1836674)

[Patent Literature 2] Japanese Patent No. 4925132B

SUMMARY OF THE INVENTION

A plasma accelerating apparatus of the present invention has a magnetic field generation body; a supply passage disposed to cross a central region of the magnetic field generation body; a cathode disposed on a downstream side from the magnetic field generation body; an anode disposed on an upstream side from the cathode; and a voltage applying unit configured to apply a voltage between the cathode and the anode. The plasma is supplied through the supply passage from the upstream side toward the downstream side. The magnetic field generation body generates an axial direction magnetic field in the center region of the magnetic field generation body, and generates a magnetic field which contains a radial direction magnetic field, on the downstream side from the magnetic field generation body. The voltage applying unit generates an electric field between the cathode and the anode. The plasma supplied through the supply passage is accelerated with a Hall electric field generated through interaction of electrons emitted from the cathode, the radial direction magnetic field, and the electric field.

A plasma acceleration method of the present invention is a method of accelerating plasma by using a plasma accelerating apparatus. The plasma accelerating apparatus includes: a magnetic field generation body; a supply passage disposed to cross a central region of the magnetic field generation body and to supply the plasma from an upstream side toward a downstream side; a cathode disposed on the downstream side from the magnetic field generation body; an anode disposed on an upstream side from the cathode; and a voltage applying unit configured to apply a voltage between the cathode and the anode. The plasma is supplied through the supply passage from the upstream side toward the downstream side. The plasma accelerating method includes: emitting electrons from the cathode; forming a Hall current by making a radial direction magnetic field generated by the magnetic field generation body capture the electrons; and accelerating the plasma supplied through the supply passage by a Hall electric field generated through interaction of the Hall current and the radial direction magnetic field.

By the above configuration, the plasma accelerating apparatus and the plasma accelerating method are provided, by which a great thrust force can be acquired.

The objects and advantages of the present invention can be easily confirmed by the following description and the attached drawings.

BRIEF DESCRIPTION OF THE DRAWINGS

The attached drawings are incorporated into this Specification to help the explanation of the embodiments. The drawings should not be interpreted to limit the present invention to illustrated examples and described examples.

DESCRIPTION OF THE EMBODIMENTS

Hereinafter, a plasma accelerating apparatus and a plasma accelerating method according to embodiments of the present invention will be described with reference to the attached drawings.

In the following detailed description, various specific matters are disclosed for description in order to provide the comprehensive understanding of the embodiments. However, it would be apparent that one or more embodiments can be realized without these detailed specific matters. Also, only an overview of a well-known structure or a well-known apparatus is shown to make the drawings simplify.

(Definition of a Coordinate System)

Figure 1:
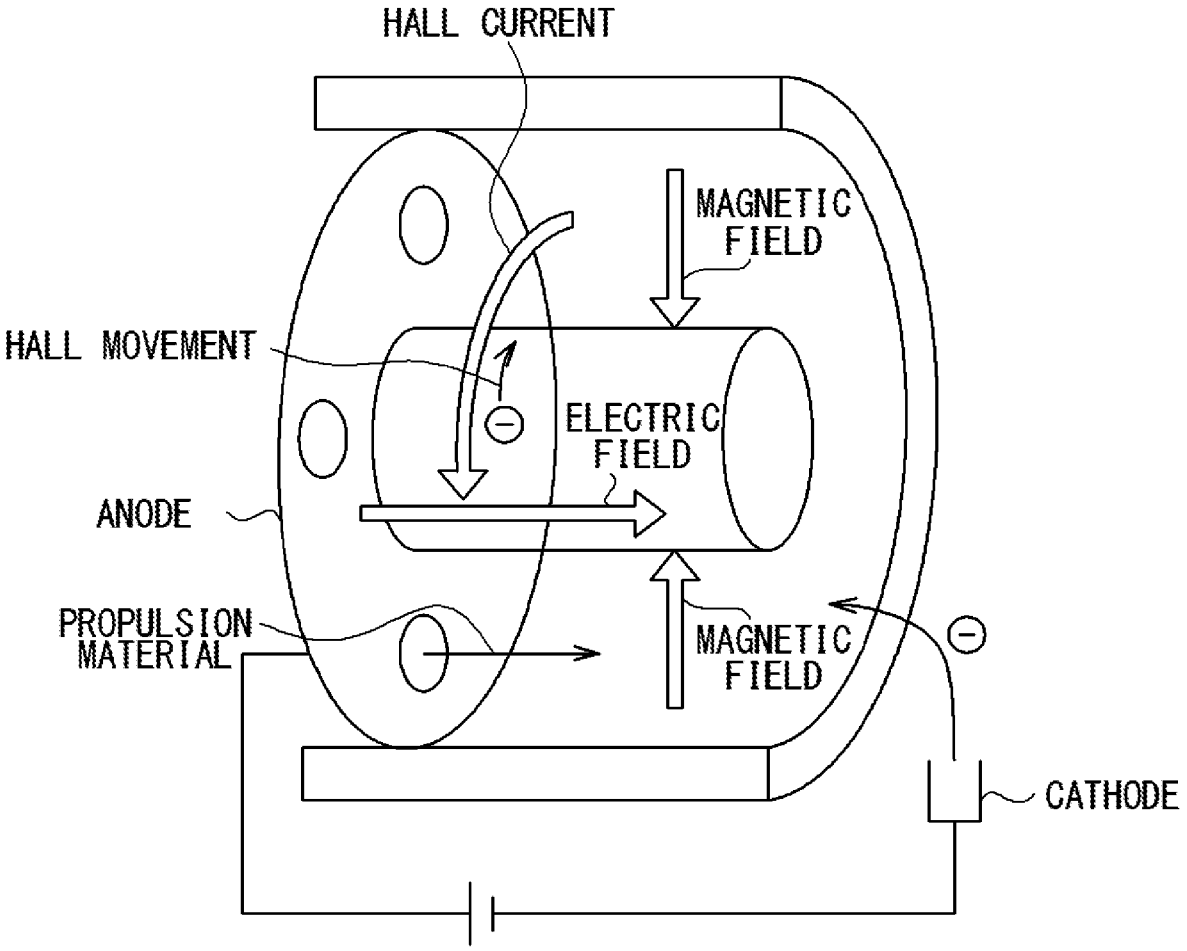
Fig. 1 PRIOR ART
FIG. 1 is a diagram schematically showing a configuration of a Hall thruster which is a conventional plasma accelerating apparatus.
Figure 2:
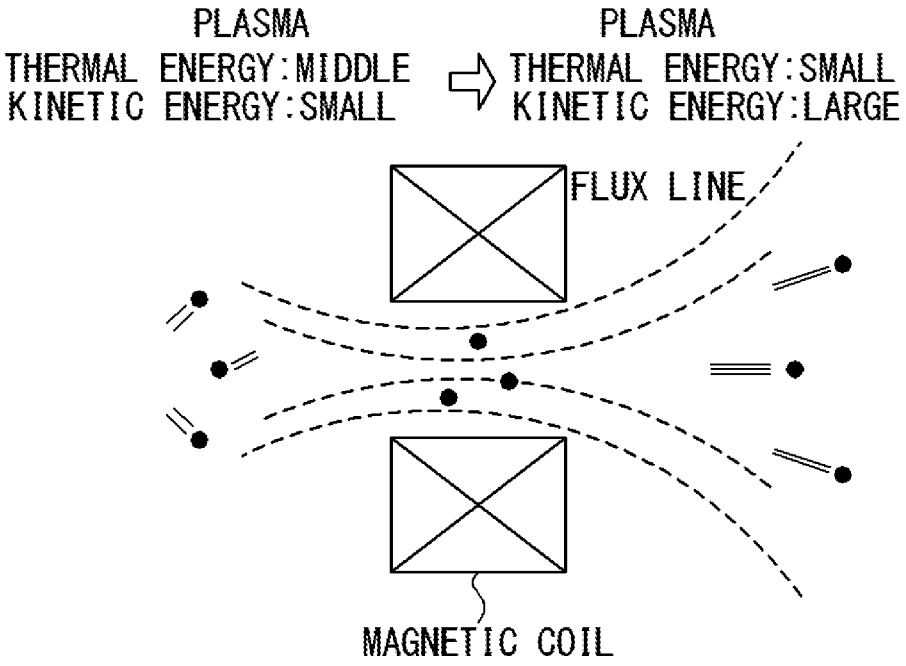
Fig. 2 PRIOR ART
FIG. 2 is a diagram schematically showing a configuration of a magnetic nozzle which is a conventional plasma accelerating apparatus.
Figure 3:
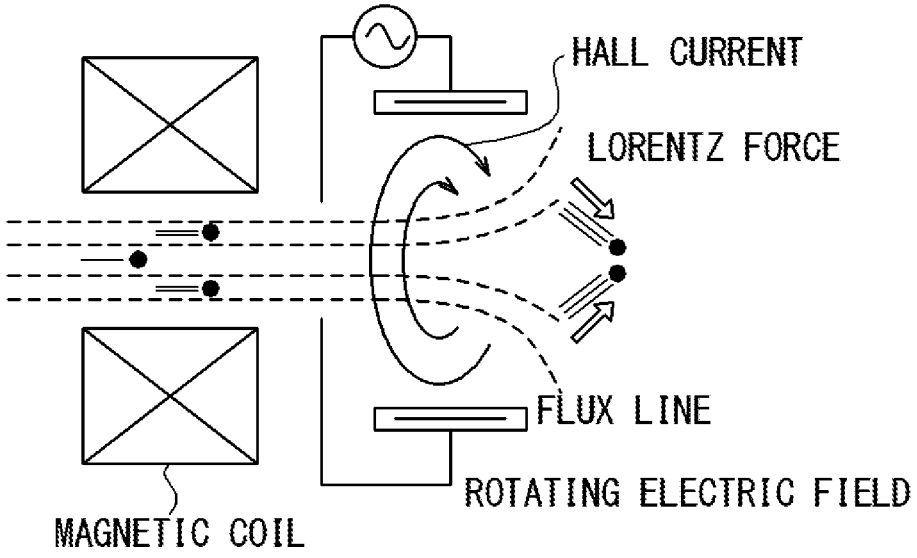
Fig. 3 PRIOR ART
FIG. 3 is a diagram schematically showing a configuration of a Lissajous accelerating apparatus which is a conventional plasma accelerating apparatus.
Figure 4:
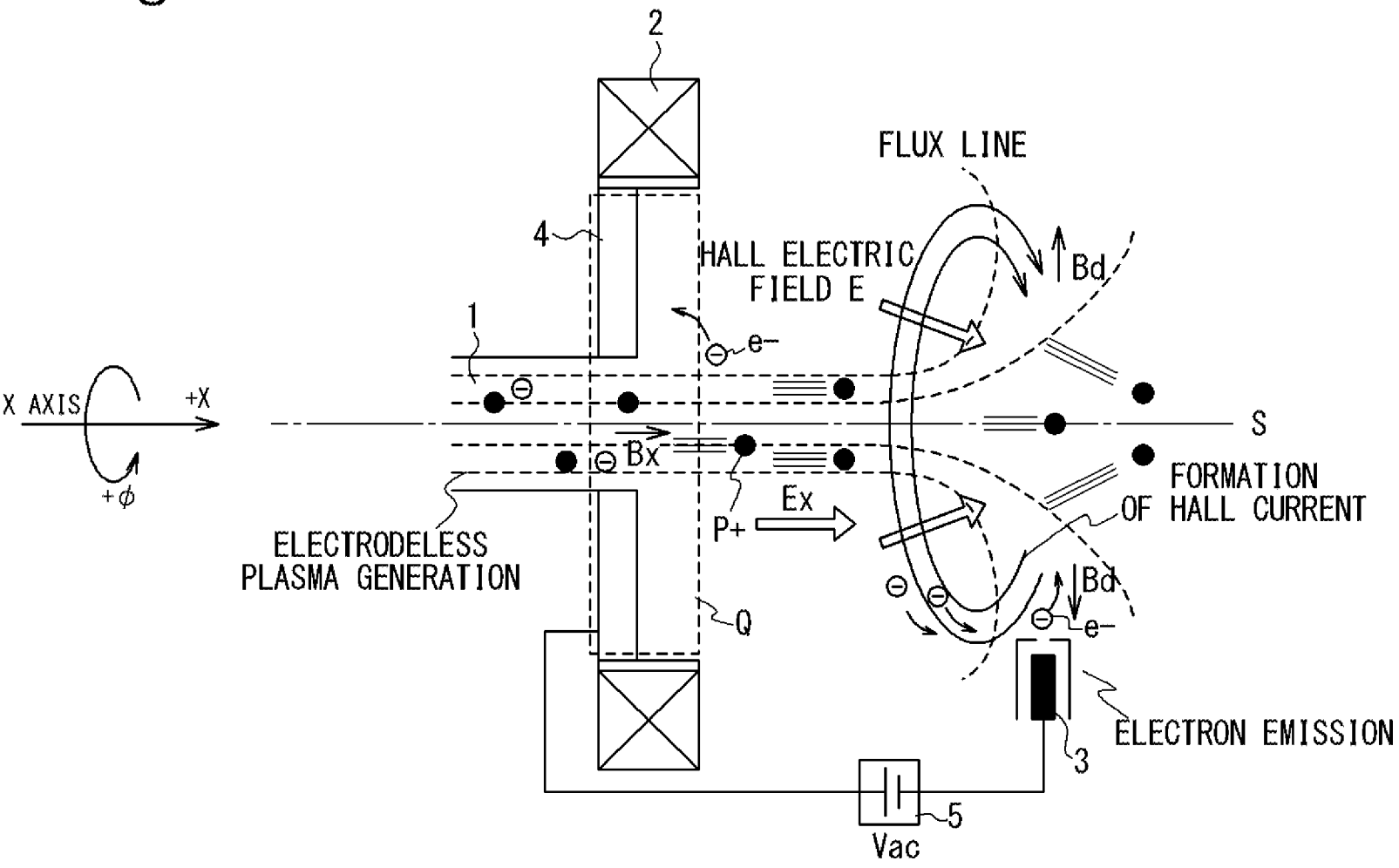
FIG. 4 is a diagram schematically showing a configuration of a plasma accelerating apparatus according to a first embodiment.
Figure 5:
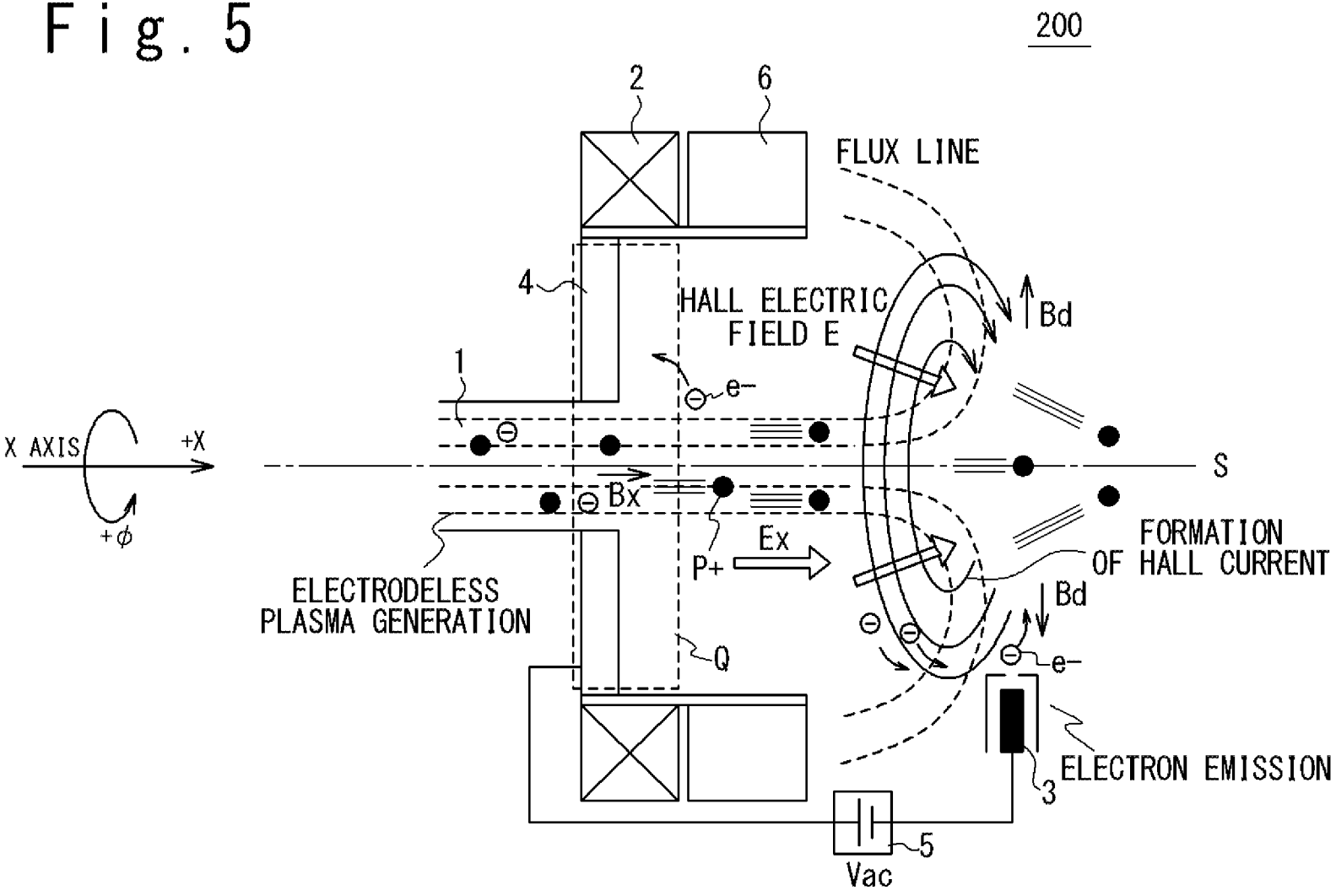
FIG. 5 is a diagram schematically showing a configuration of the plasma accelerating apparatus according to a second embodiment.
Figure 6:
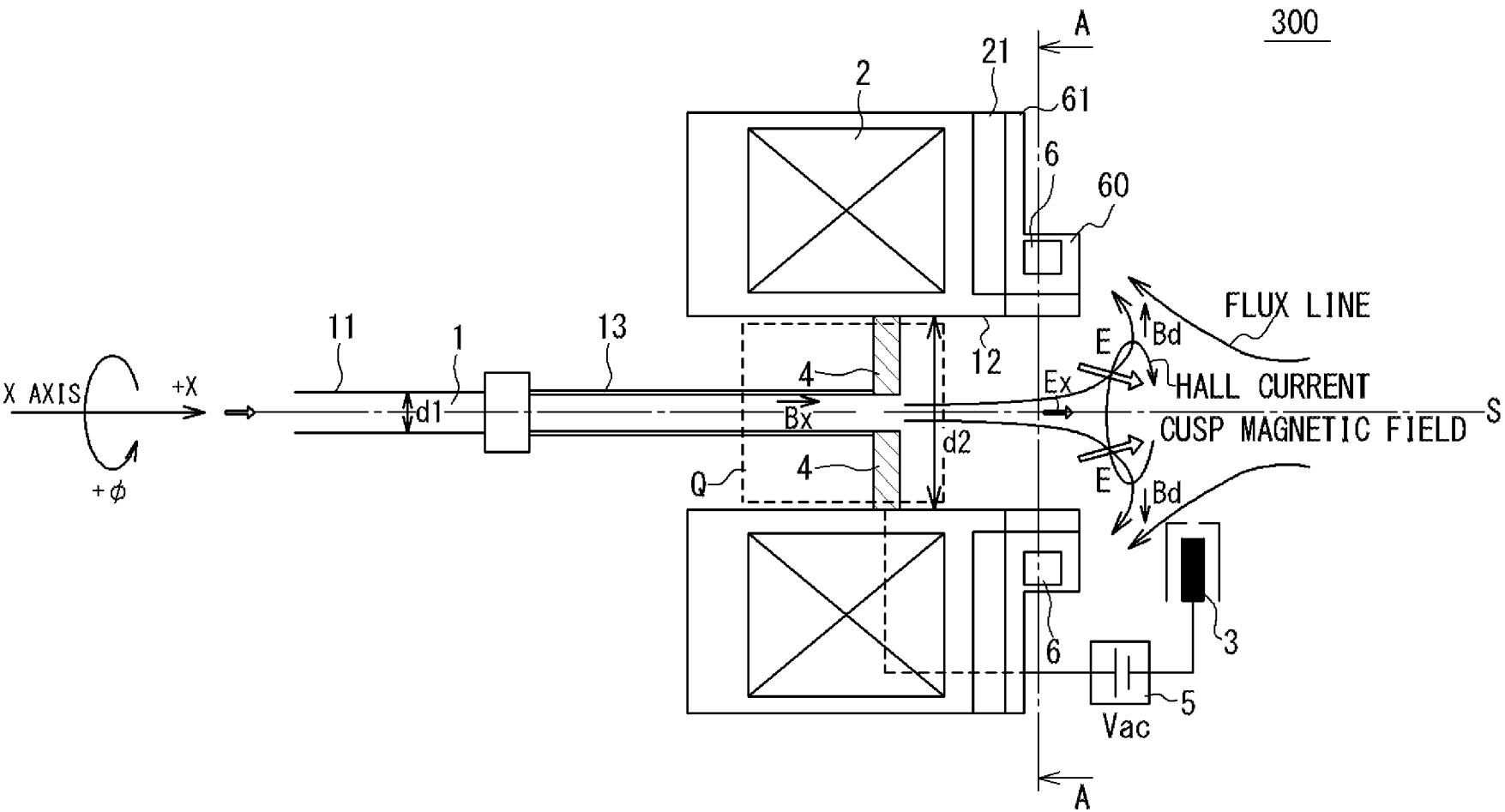
FIG. 6 is a diagram schematically showing a configuration of the plasma accelerating apparatus according to a third embodiment.

A coordinate system is defined with reference to FIG. 4, FIG. 5 and FIG. 6. An X direction is a direction of an X axis as a central axis of plasma accelerating apparatuses 100, 200, or 300. A +X direction is a rear direction of the plasma accelerating apparatus 100, 200, or 300, and that is, means a direction to which the plasma is emitted. The ϕ direction is a rotation direction around the X axis, and the +ϕ direction means a clockwise direction when viewing in the +X direction.

(Definition of Important Terms)

In the present embodiment, the side in the +X direction is defined as "a downstream side", and the side in the −X direction is defined as "an upstream side". Also, "electrodeless plasma" is defined as plasma generated by an electrodeless plasma generating apparatus. "The electrodeless plasma generating apparatus" is defined as a plasma generating apparatus in which an electrode and plasma do not contact directly in a plasma generation process.

[First Embodiment]

The plasma accelerating apparatus according to a first embodiment will be described with reference to FIG. 4. FIG. 4 is a diagram schematically showing the configuration of the plasma accelerating apparatus of the first embodiment.

1. Configuration of Plasma Accelerating Apparatus 100

The plasma accelerating apparatus 100 includes a plasma supply passage 1, a magnetic coil 2, a cathode 3, an anode 4, and a voltage applying unit 5. The supply passage 1 is a passage to supply plasma from the upstream side to the downstream side. An upstream section of the supply passage 1 is configured from, for example, a plasma supply pipe. Note that it is desirable that the plasma supply pipe is a pipe having a circular section. The downstream section of the supply passage 1 is a space on the downstream side from the plasma supply pipe. Also, it is desirable that the plasma supplied through the supply passage 1 is electrodeless plasma generated by the electrodeless plasma generating apparatus. The magnetic coil 2 is arranged to surround the supply passage 1. In other words, the supply passage 1 crosses the central region Q of the magnetic coil 2. Here, the central region Q of the magnetic coil 2 means a cavity region inside the inner diameter of the magnetic coil 2 (a region surrounded by a broken line in FIG. 4). Note that it is desirable that the central axis S of the magnetic coil 2 coincides with the X axis. The magnetic coil 2 generates an axial direction magnetic field Bx along the central axis S of the magnetic coil in the central region Q of the magnetic coil. The axial direction magnetic field Bx is spread to the direction going away from the center axis S on the downstream side. The spread magnetic field contains a radial direction magnetic field Bd as a component spreading radially from the center axis S. Note that the magnetic coil 2 can be substituted with a first ferromagnetic material (not shown) that generates the axial direction magnetic field Bx and the radial direction magnetic field Bd. The magnetic coil 2 and the first ferromagnetic material can be said as the magnetic field generation body (a generation body of the axial direction magnetic field and the radial direction magnetic field) which generates the magnetic field (the axial direction magnetic field and the radial direction magnetic field). The cathode 3 emits electrons. It is desirable that the cathode 3 is a hollow cathode having fine holes. The anode 4 is arranged on the upstream side from the cathode 3. The voltage applying unit 5 applies an application voltage Vac between the cathode 3 and the anode 4 to generate an electric field Ex in the X direction.

2. Operation Principle of Plasma Accelerating Apparatus 100

Next, the operation principle of the plasma accelerating apparatus 100 will be described.

(1) By operating the magnetic coil 2, the axial direction magnetic field Bx is generated in the central region Q of the magnetic coil 2. Also, by operating the magnetic coil 2, the magnetic field which contains the radial direction magnetic field Bd is generated on the downstream side from the magnetic coil 2. Alternatively, the axial direction magnetic field Bx and the radial direction magnetic field Bd may be generated by the first ferromagnetic material.

(2) The electric field Ex in the X direction is generated between the cathode 3 and the anode 4 through the voltage application by the voltage applying unit 5. Also, the electrons e are emitted from the cathode 3.

(3) The plasma is supplied through the supply passage 1.

(4) The plasma supplied through the supply passage 1 (especially, positive ions $P^+$) is accelerated to the downstream direction by the Hall electric field E generated through interaction of the electrons $e^-$ emitted from the cathode 3, the radial direction magnetic field Bd and the electric field Ex. Note that the overview of the mechanism of acceleration due to the Hall electric field E is as follows (4a), (4b), and (4c).

(4a) The electrons $e^-$ are emitted from the cathode 3 toward the region where the radial direction magnetic field Bd and the electric field Ex exist. The emitted electrons $e^-$ are captured by the radial direction magnetic field Bd to carry out a Hall movement. A Hall current is generated by the Hall movement of the electrons $e^-$. In other words, the electrons $e^-$emitted from the cathode 3 generate the Hall current (for example, a current which turns in the −ϕ direction around the central axis S) through interaction of the radial direction magnetic field Bd and the electric field Ex.

(4b) The Hall electric field E is generated due to the interaction (Hall effect) of the Hall current and the radial direction magnetic field Bd.

(4c) The plasma is supplied through the supply passage 1 under the existence of the Hall electric field E. The plasma contains ionized positive ions $P^+$ and electrons $e^-$. A part of the ionized electrons $e^-$ is captured by the anode 4. A part of the ionized electrons $e^-$ is captured with the radial direction magnetic field Bd to enhance the Hall current. The ionized positive ions $P^+$are accelerated to the downstream direction with the Hall electric field E. Note that the electric field Ex in the X direction generated between the cathode 3 and the anode 4 assists the acceleration of the plasma (positive ions $P^+$).

(5) A part of the accelerated positive ions $P^+$ collides with a part of the electrons $e^-$ emitted from the cathode, and is emitted to the downstream direction of the plasma accelerating apparatus 100 in the neutralized condition. A part of the accelerated positive ions $P^+$ attracts a part of the electrons e emitted from the cathode with the coulomb force, and is emitted to the downstream direction of the plasma accelerating apparatus 100 together with the attracted electrons $e^-$.

3. Effect

The particles emitted to the downstream direction of the plasma accelerating apparatus 100 (particles generated through collision of the positive ions $P^+$ and the electrons $e^-$) or the plasma is the electrically neutral particles or the electrically neutral plasma (positive ions $P^+$ emitted together with electrons $e^-$). Therefore, the plasma accelerating apparatus 100 is not affected by a spatial charge limitation (an upper limit of a current density that can be supplied, when the ions are accelerated with a potential difference applied between electrodes) because the electrically neutral condition is almost maintained. Therefore, the plasma accelerating apparatus 100 of the first embodiment is possible to make the thrust force large.

Also, the plasma accelerating apparatus 100 of the first embodiment does not use a rotating electric field or a rotating magnetic field, unlike a Lissajous accelerating apparatus. Therefore, the electrodeless plasma can be effectively accelerated even when the high density electrodeless plasma is supplied through the supply passage 1. Therefore, the plasma accelerating apparatus 100 of the first embodiment is possible to make the thrust force large.

Also, according to the plasma accelerating apparatus of the present embodiment, the following problem in the acceleration of the electrodeless plasma can be overcome.

(Problem in Acceleration of Electrodeless Plasma)

First, a problem in the acceleration of the electrodeless plasma by using a magnetic nozzle will be described. The electrodeless plasma has only the electron temperature of several eV to 10 eV upon the generation. Therefore, a large thrust force cannot be attained even if an electron temperature, namely, the thermal energy is converted to the kinetic energy. For this reason, it would be considered the electrodeless plasma is heated to raise the electron temperature. However, it is not desirable from the viewpoint of the energy efficiency. Also, a new problem is caused that a strong magnetic field becomes necessary to confine the plasma when heating the plasma.

Next, a problem in the acceleration of the electrodeless plasma by using the Lissajous accelerating apparatus will be described. In the Lissajous accelerating apparatus, it is necessary for the electric field or the magnetic field to sufficiently penetrate into the plasma in a process of inducing the Hall current. However, when the density of the plasma is high, the electric field or the magnetic field is applied only to the surface of the plasma, and does not penetrate to the center of the plasma. Accordingly, the Hall current cannot be induced. Accordingly, the Lissajous accelerating apparatus cannot increase the plasma density, and as the result, a large thrust force cannot be obtained.

[Second Embodiment]

With reference to FIG. 5, the plasma accelerating apparatus according to a second embodiment will be described. FIG. 5 is a diagram schematically showing the configuration of the plasma accelerating apparatus of the second embodiment.

In the second embodiment, the same reference numerals as in the first embodiment are used for the same component. The plasma accelerating apparatus 200 of the second embodiment is different from the plasma accelerating apparatus 100 of the first embodiment in the point that a second ferromagnetic material 6 (a magnetic circuit that forms the passage of a magnetic flux) is provided. A specific position of the second ferromagnetic material 6 which is arranged on the downstream side from the magnetic coil 2 (or the first ferromagnetic material) is optional. Note that it is desirable that the second ferromagnetic material 6 is arranged on the downstream side from the magnetic coil (or the first ferromagnetic material) to be adjacent to the magnetic coil 2 (or the first ferromagnetic material). In this case, the word of "adjacent" is used to mean a range from a state that the distance is zero (the magnetic coil 2 (or the first ferromagnetic material) and the second ferromagnetic material 6 come in contact with each other) to a state that the magnetic coil 2 (or the first ferromagnetic material) and the second ferromagnetic material 6 are separated by 100 mm. Also, it is desirable that the second ferromagnetic material 6 is arranged annularly (in a ring shape) around the supply passage 1.

The second ferromagnetic material 6 collects the magnetic fluxes on the downstream side from the magnetic coil 2 (or the first ferromagnetic material) to form strong radial direction magnetic field Bd. Therefore, the generated Hall current and Hall electric field E are enhanced, compared with the first embodiment. As a result, the acceleration of the plasma due to the Hall electric field E is improved.

The operation principle of the present embodiment is the same as that of the first embodiment.

In addition to the same effect as in the first embodiment, the present embodiment is possible to further increase the thrust force, compared with the plasma accelerating apparatus of the first embodiment.

[Third Embodiment]

With reference to FIG. 6, the plasma accelerating apparatus according to a third embodiment will be described. FIG. 6 is a diagram schematically showing the configuration of the plasma accelerating apparatus of the third embodiment.

In the third embodiment, the same reference numerals are assigned to the same components as in the first embodiment.

1. Configuration of Plasma Accelerating Apparatus 300

The plasma accelerating apparatus 300 includes the supply passage 1 of plasma, the magnetic coil 2 (or, the first ferromagnetic material), the cathode 3, the anode 4, the voltage applying unit 5, and the second ferromagnetic material 6 (the magnetic circuit which forms the passage of magnetic fluxes).

(Plasma Supply Passage 1)

The supply passage 1 is a passage that supplies plasma for the downstream side from the upstream side. For example, an upstream section of the supply passage 1 is configured from an upstream pipe 11. For example, a downstream section of the supply passage 1 is configured from a downstream pipe 12. It is desirable that that each of the upstream pipe 11 and the downstream pipe 12 is a pipe having a circular section. A propulsion material (e.g. argon gas, xenon gas) is supplied from the upstream of the upstream pipe 11. Also, the antenna 13 is arranged around the upstream pipe 11 to metamorphose the propulsion material into plasma. For example, the antenna 13 is a helical antenna. An electric field is induced when a high frequency current is applied to the helical antenna. A helicon wave is generated through interaction of the electric field and the axial direction magnetic field Bx which is generated by the the magnetic coil 2 to be described later. It is desirable that the antenna 13 is inserted inside the magnetic coil 2 to generate the helicon wave. In other words, it is desirable that the magnetic coil 2 and the antenna 13 overlap at at least a part in the direction of the supply passage 1 (the direction of the supply passage 1 and the direction of the X axis coincide desirably). The helicon wave acts on the propulsion material and generates helicon plasma. The generated helicon plasma is supplied to the downstream pipe 12. Note that it is desirable to form the upstream pipe 11 and the downstream pipe 12 of an insulation material. As the insulation material, for example, the photoveel (registered trademark) can be used. Also, the inner diameter d1 of the upstream pipe 11 is desirably equal to or more than 20 mm and equal to or less than 100 mm in order to ionize the propulsion material by applying the electric field and the axial direction magnetic field Bx.

(Example of Antenna 13)

Figure 7A:
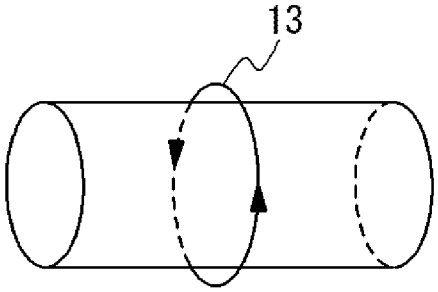
FIG. 7A is a diagram showing a first example of a plasma generation antenna.
Figure 7B:
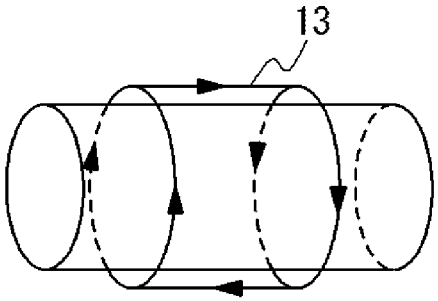
FIG. 7B is a diagram showing a second example of the plasma generation antenna.
Figure 7C:
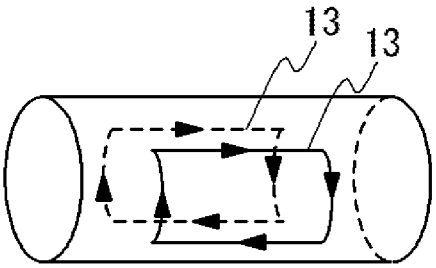
FIG. 7C is a diagram showing a third example of the plasma generation antenna.
Figure 7D:
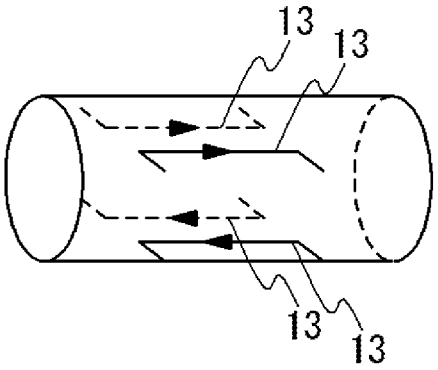
FIG. 7D is a diagram showing a fourth example of the plasma generation antenna.
Figure 7E:
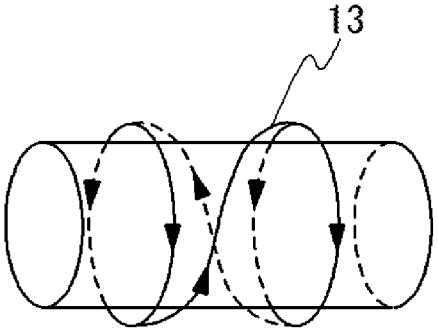
FIG. 7E is a diagram showing a fifth example of the plasma generation antenna.
Figure 7F:
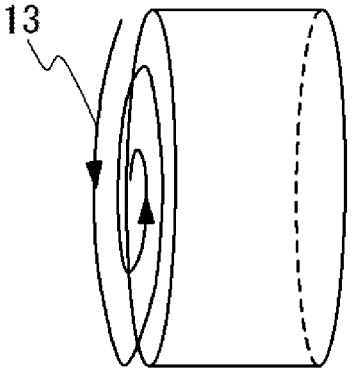
FIG. 7F is a diagram showing a sixth example of the plasma generation antenna.

As an antenna 13, antennas of various forms can be adopted. FIG. 7A shows a first example of the antenna. The antenna of the first example is a loop antenna. FIG. 7B shows a second example of the antenna. The antenna of the second example is Boswell antenna. FIG. 7C shows a third example of the antenna. The antenna of the third example is a saddle-type antenna. FIG. 7D shows a fourth example of the antenna. The antenna of the fourth example is a Nagoya-type third-type antenna. In this antenna, it is possible to select from a plurality of modes by changing phases of four coil currents. FIG. 7E shows a fifth example of the antenna. The antenna of the fifth example is a helical antenna. FIG. 7F shows a sixth example of the antenna. The antenna of the sixth example is a spiral-type antenna. It is possible to apply the antenna to the plasma supply passage with a large diameter.

(Magnetic Coil 2)

The magnetic coil 2 is disposed to surround the supply passage 1. In other words, the supply passage 1 crosses the central region Q of the magnetic coil 2. Here, the central region Q of the magnetic coil 2 means a cavity region inside the inner diameter of the magnetic coil 2 (a region surrounded by the broken line in FIG. 6). It is desirable that the central axis S of the magnetic coil 2 coincides with the X axis. Desirably, the inner circumference surface of the magnetic coil 2 is arranged to oppose to the outer surface of the upstream pipe 11 and/or the downstream pipe 12. The magnetic coil 2 is supported by the supporting member 21. The magnetic coil 2 generates the axial direction magnetic field Bx along the central axis S in the central region Q of the coil. The axial direction magnetic field Bx spreads into the direction away from the center axis S on the downstream side from the magnetic coil 2 and the second ferromagnetic material 6. That is, the magnetic coil 2 provides the radial direction magnetic field Bd for plasma-gasification of the propulsion material and provides the axial direction magnetic field Bx to generate a Hall electric field. It is desirable that the inner diameter d2 of the downstream pipe 12 is greater than the inner diameter d1 of the upstream pipe 11, in order to spread the magnetic field on the downstream side from the magnetic coil 2 and the second ferromagnetic material 6. Note that it is possible to substitute the first ferromagnetic material (not shown) which generates the axial direction magnetic field Bx and the radial direction magnetic field Bd, for the magnetic coil 2.

(Second Ferromagnetic Material 6 (Magnetic Circuit Which Forms a Passage of Magnetic Fluxes))

Figure 8:
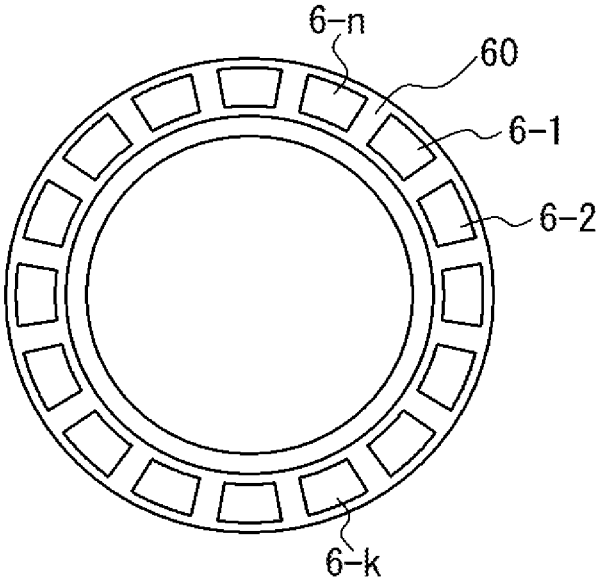
FIG. 8 is a sectional view along the A-A line of FIG. 6 and shows the arrangement of division fragments of a magnetic flux collecting body (a second ferromagnetic material).

The second ferromagnetic material 6 is arranged on the downstream side from the magnetic coil (or the first ferromagnetic material). It is desirable that the second ferromagnetic material 6 is arranged (arranged to surround downstream pipe 12) around the downstream pipe 12. It is desirable that the second ferromagnetic material 6 is arranged on the downstream side from the magnetic coil 2 (or the first ferromagnetic material) to be adjacent to the magnetic coil. It is desirable that the second ferromagnetic material 6 is arranged annularly (in a ring form) around the supply passage 1. The second ferromagnetic material 6 gathers the magnetic fluxes on the downstream side from the magnetic coil 2 (or the first ferromagnetic material) and the second ferromagnetic material 6 and generates the strong radial direction magnetic field Bd. That is, it is possible to say that the second ferromagnetic material 6 is a magnetic flux collecting body. Therefore, the generated Hall current and Hall electric field E are strengthened, compared with the first embodiment. As a result, the acceleration of the plasma with the Hall electric field E is enhanced. Note that as shown in FIG. 8 (a sectional view along the line A-A in FIG. 6), the second ferromagnetic material 6 may be composed of a plurality of pieces 6-1, 6-2, . . . , 6-n. The plurality of pieces 6-1, 6-2, . . . , and 6-n are arranged in an equal interval around the supply passage 1. In an example of FIG. 8, the number of pieces is 16, but the embodiment is not limited to this example. By configuring the second ferromagnetic material 6 from the plurality of pieces, the manufacturing cost of the second ferromagnetic material 6 can be reduced. Note that the second ferromagnetic material 6 is formed from neodymium magnets.

The second ferromagnetic material 6 is attached to a yoke 60. The Yoke 60 is attached to the supporting member 21 which supports the magnetic coil (or the first ferromagnetic material). The material of the yoke 60 is of, for example, soft iron. The yoke 60 has an extension section 61 extending in an outer direction of the second ferromagnetic material 6 (in a direction out of the diameter). The shape of the extension section 61 has a plate-like ring shape. By having the extension section 61, the magnetic fluxes on the downstream side from the magnetic coil 2 (or the first ferromagnetic material) and the second ferromagnetic material 6 can be more strongly gathered. Note that the material of the extension section 61 is of soft iron.

A region (of a cusp magnetic field) with a sparse magnetic flux density is formed on the downstream side from the magnetic coil 2 (or the first ferromagnetic material) and the second ferromagnetic material 6 by the magnetic coil 2 (or the first ferromagnetic material) and the second ferromagnetic material 6 (the magnetic circuit) (more specifically, in the center section of a circular current path of the Hall current).

(Cathode 3)

The cathode 3 emits electrons. It is desirable that the cathode 3 is a hollow cathode having fine holes. The hollow cathode may have an insert which is a chemical substance. When this insert is heated to a high temperature by a heater, the insert emits thermal electrons. The emitted thermal electrons collide with an operation gas which is supplied into the hollow cathode, to carry out ionization and to generate a plasma gas in the hollow cathode. When a positive electrode is arranged on the outlet side from the cathode, the electrons are emitted from the plasma to the outside of the cathode.

(Anode 4)

Figure 9:
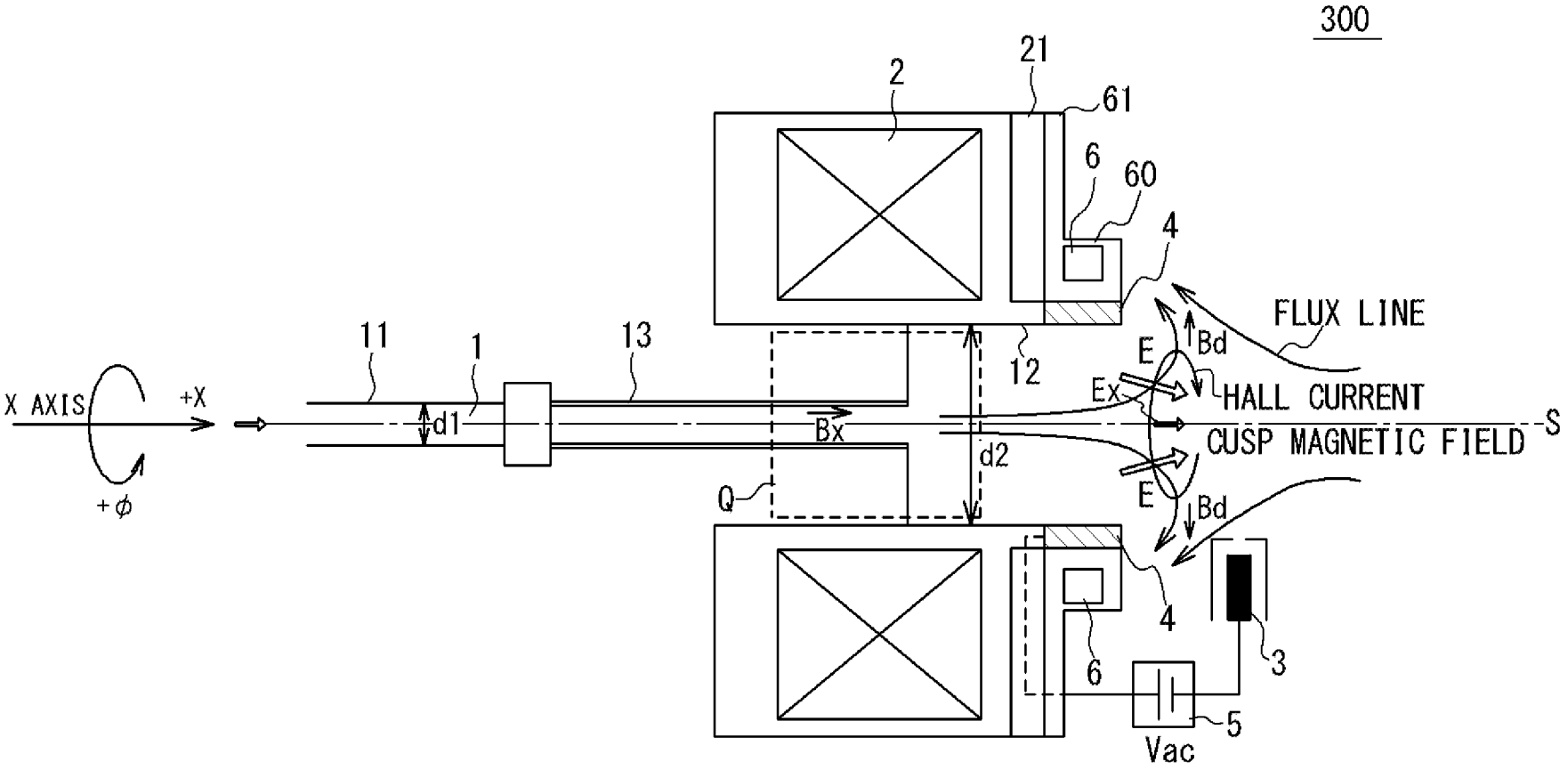
FIG. 9 is a diagram showing a modification example of the position of an anode in the plasma accelerating apparatus according to the third embodiment.

The anode 4 is arranged on the upstream side from the cathode 3. The anode 4 may be arranged on the upstream side from the downstream end of the magnetic coil 2 (or the first ferromagnetic material). Also, the anode 4 may be arranged on the downstream side from the upstream end of the magnetic coil 2 (or first ferromagnetic material). Note that it is desirable that the anode 4 is arranged inside the downstream pipe 12 at the upstream end of the downstream pipe 12. That is, it is desirable to install the anode 4 in an inner diameter expansion section between the upstream pipe 11 and the downstream pipe 12. However, the position of the anode 4 to be arranged is not limited to the above-mentioned example. The anode 4 may be provided in any position of the downstream pipe 12. For example, as shown in FIG. 9, the anode may be provided at the downstream end of the downstream pipe 12. Also, for example, the anode 4 is formed of copper.

2. Operation Principle of Plasma Accelerating Apparatus 300

Next, the operation principle of the plasma accelerating apparatus 300 will be described.

(1) By operating or energizing the magnetic coil 2, the axial direction magnetic field Bx is generated in the central region Q of the magnetic coil 2. Also, by operating the magnetic coil 2, the magnetic field which contains the radial direction magnetic field Bd is generated on the downstream side from the magnetic coil 2 and the second ferromagnetic material 6. Alternatively, the axial direction magnetic field Bx and the radial direction magnetic field Bd may be generated by the first ferromagnetic material and second ferromagnetic material 6.

(2) By the voltage application by the voltage applying unit 5, the electric field Ex in the X direction is generated between the cathode 3 and the anode 4. Also, electrons $e^-$ are emitted from the cathode 3.

(3) The propulsion material (e.g. argon gas, xenon gas) is supplied to the upstream pipe 11.

(4) An electric field is induced by applying a high frequency current to the antenna 13. The helicon wave is generated through the interaction of the axial direction magnetic field Bx generated by the magnetic coil 2 (or the first ferromagnetic material) and the electric field.

(5) The helicon wave acts on the propulsion material supplied to the upstream pipe 11 to plasma-gasify the propulsion material.

(6) The propulsion material in a plasma state (the electrodeless plasma) is supplied from the upstream pipe 11 toward the downstream pipe 12 and moreover is emitted to the downstream side from the downstream pipe 12.

(7) The emitted electrodeless plasma (the electrodeless plasma supplied through the supply passage 1, especially, positive ions $P^+$ of electrodeless plasma) is accelerated with the Hall electric field E that is generated through the interaction of the electrons $e^-$ emitted from the cathode 3, the radial direction magnetic field Bd and the electric field Ex. The overview of an acceleration mechanism due to the Hall electric field E is as the followings (7a), (7b), and (7c).

(7a) The electrons $e^-$are emitted from the cathode 3 toward the region where the radial direction magnetic field Bd and the electric field Ex exist. The emitted electrons $e^-$ are captured with the radial direction magnetic field Bd to start the Hall movement. The Hall current (for example, a current which turns around the central axis S into the $-\phi$ direction) is generated by the Hall movement of the electrons $e^-$. In other words, the electrons $e^-$ emitted from the cathode 3 generates the Hall current through the interaction of the radial direction magnetic field Bd and the electric field Ex.

(7b) The Hall electric field E is generated through the interaction of the Hall current and the radial direction magnetic field Bd (Hall effect).

(7c) Under the existence of the Hall electric field E, the electrodeless plasma is supplied through the supply passage 1. The electrodeless plasma contains the ionized positive ions $P^+$ and electrons $e^-$. A part of the ionized electrons $e^-$ is captured by the anode. A part of the ionized electrons $e^-$ is captured by the radial direction magnetic field Bd to enhance the Hall current. The ionized positive ions $P^+$ are accelerated to the downstream direction with the Hall electric field E. Note that the electric field Ex in the X direction which is generated between the cathode 3 and the anode 4 assists the acceleration of the plasma (positive ions $P^+$).

(8) A part of the accelerated positive ions $P^+$ collide with the electrons $e^-$ which form the Hall current, and emitted to the downstream direction of the plasma accelerating apparatus 300 in the electrically neutralized condition. A part of the accelerated positive ions $P^+$ attract the electrons $e^-$ which form the Hall current with the coulomb force, and emitted to the downstream direction of the plasma accelerating apparatus 300 together with the electrons $e^-$.

(9) Note that the positive ions $P^+$pass through a region with a sparse magnetic flux density (cusp magnetic field), and released from the restraint by the magnetic fluxes. Therefore, the positive ions $P^+$ are diffused and emitted for the downstream direction of the plasma accelerating apparatus 300.

3. Effect

The present embodiment achieves the following effects in addition to the same effect as in the first embodiment. At first, because the Hall electric field is enhanced by the existence of the second ferromagnetic material, it is possible to further increase the thrust force. At second, because helicon plasma is used as the plasma, it is possible to change the plasma to a high density. Therefore, it is possible to further increase the thrust force. At third, the magnetic coil 2 (or the first ferromagnetic material) generates the axial direction magnetic field Bx for the plasma generation and forms the radial direction magnetic field Bd for the Hall current generation. That is, because the magnetic coil 2 (or the first ferromagnetic materials) is used for the generation of the plasma and the acceleration of the plasma, the whole apparatus can be made compact.

The present invention is not limited to each of the above embodiments. It would be apparent that each embodiment may be changed or modified appropriately in the range of the technical thought of the present invention. Also, various techniques used in the embodiments can be applied to the other embodiment, as far as unless causing the technical contradiction.

The present application claims a priority based on Japanese Patent Application 2014-107585 which was filed on May 23, 2014. The disclosure thereof is incorporated herein by reference.

The invention claimed is:

1. A plasma accelerating apparatus, comprising:

a coil circumscribing a central region disposed therein;

a supply passage disposed to cross the central region of the coil, and configured to supply plasma from upstream of the coil to downstream of the coil through the central region;

a cathode disposed downstream of the coil;

an anode disposed upstream of the cathode;

a voltage applying unit configured to generate a first electric field between the cathode and the anode; and a magnetic flux collection body disposed downstream of the coil, wherein the coil generates an axial direction magnetic field in the central region of the coil, and generates a magnetic flux which reaches a downstream position of the coil and the magnetic flux collection body, the magnetic flux having a radial direction component at the downstream position, wherein the plasma supplied through the supply passage is accelerated with a Hall electric field generated through interaction of electrons emitted from the cathode, the radial direction component, and the first electric field, wherein the magnetic flux collection body is configured to direct the magnetic flux generated by the coil toward a downstream side of the magnetic flux collection body from the downstream position, and wherein the axial direction magnetic field and a second electric field cooperate to generate the plasma.

2. The plasma accelerating apparatus according to claim 1, wherein a downstream region with a sparse magnetic flux density is formed downstream of the coil and the magnetic flux collection body by the coil and the magnetic flux collection body, and the plasma which passes through the downstream region is diverged for a downstream direction.

3. The plasma accelerating apparatus according to claim 1, wherein the magnetic flux collection body is configured from a plurality of division fragments, and wherein the plurality of division fragments are arranged in an equal interval around the supply passage.

4. The plasma accelerating apparatus according to claim 1, wherein the magnetic flux collection body is installed to a yoke.

5. The plasma accelerating apparatus according to claim 4, wherein the yoke has an extension section extending into a direction out of a diameter from the magnetic flux collection body.

6. The plasma accelerating apparatus according to claim 1, further comprising a plasma generation antenna, wherein the supply passage includes an upstream pipe positioned upstream of the coil, wherein the plasma generation antenna is arranged to surround the upstream pipe, and wherein the plasma is electrodeless plasma and the second electric field is induced by the plasma generation antenna.

7. The plasma accelerating apparatus according to claim 6, wherein the plasma generation antenna is a helical antenna and the electrodeless plasma is helicon plasma.

8. The plasma accelerating apparatus according to claim 6, wherein the coil and the plasma generation antenna overlap with each other in at least a part in a longitudinal direction of the supply passage.

9. The plasma accelerating apparatus according to claim 6, wherein a diameter of a part of the supply passage around which the plasma generation antenna is arranged is equal to or more than 20 mm and equal to or less than 100 mm.

10. The plasma accelerating apparatus according to claim 1, wherein the cathode is a hollow cathode which has fine holes.

11. The plasma accelerating apparatus according to claim 1, wherein the supply passage contains an upstream pipe and a downstream pipe, and a first diameter of the downstream pipe is greater than a second diameter of the upstream pipe.

12. The plasma accelerating apparatus according to claim 11, wherein the anode is provided for the downstream pipe.

13. A plasma acceleration method, comprising:

providing a plasma accelerating apparatus according to claim 1;

emitting electrons from the cathode by applying a voltage between the cathode and the anode;

generating the magnetic flux which reaches the downstream position of the coil and the magnetic flux collection body, the magnetic flux having the radial direction component at the downstream position;

forming a Hall current by making the magnetic flux capture the electrons; supplying plasma by the supply passage from upstream of the coil to downstream of the coil through the central region; and accelerating the plasma received from the central region of the coil by the Hall electric field generated through interaction of the Hall current and the magnetic flux.

14. The plasma accelerating apparatus according to claim 11, wherein a downstream end of the upstream pipe is positioned upstream of a downstream end of the coil, and wherein the plasma is generated in the upstream pipe.

* * * * *